US010197346B2

(12) United States Patent
Kesälä

(10) Patent No.: US 10,197,346 B2
(45) Date of Patent: Feb. 5, 2019

(54) METHOD FOR CLEANING PLATE HEAT EXCHANGER AND PLATE HEAT EXCHANGER

(71) Applicant: VAHTERUS OY, Kalanti (FI)

(72) Inventor: Ville Kesälä, Turku (FI)

(73) Assignee: VAHTERUS OY, Kalanti (FI)

( * ) Notice: Subject to any disclaimer, the term of this patent is extended or adjusted under 35 U.S.C. 154(b) by 54 days.

(21) Appl. No.: 14/783,890

(22) PCT Filed: Apr. 9, 2014

(86) PCT No.: PCT/FI2014/050256
§ 371 (c)(1),
(2) Date: Oct. 12, 2015

(87) PCT Pub. No.: WO2014/167183
PCT Pub. Date: Oct. 16, 2014

(65) Prior Publication Data

US 2016/0054079 A1 Feb. 25, 2016

(30) Foreign Application Priority Data

Apr. 12, 2013 (FI) ..... 20135362

(51) Int. Cl.
*F28D 9/00* (2006.01)
*F28F 3/08* (2006.01)
(Continued)

(52) U.S. Cl.
CPC ..... *F28G 13/00* (2013.01); *F28D 9/0006* (2013.01); *F28D 9/0012* (2013.01);
(Continued)

(58) Field of Classification Search
CPC .. F28G 5/00; F28G 13/00; F28G 15/02; F28F 3/08; F28F 3/083; F28F 9/005; F28D 9/0006; F28D 9/0012; F28D 9/0043
(Continued)

(56) References Cited

U.S. PATENT DOCUMENTS 4,260,013 A * 4/1981 Sumitomo ..... F28F 3/083 165/145
6,918,433 B2 * 7/2005 Kontu ..... F28D 9/0006 165/135
(Continued)

FOREIGN PATENT DOCUMENTS

DE 2 007 386 9/1971
WO WO 93/08438 4/1993
(Continued)

OTHER PUBLICATIONS

International Search Report for PCT/FI2014/050256 dated Jul. 4, 2014, three pages.
(Continued)

*Primary Examiner* — Len Tran
*Assistant Examiner* — Hans Weiland
(74) *Attorney, Agent, or Firm* — Nixon & Vanderhye P.C.

(57) ABSTRACT

The invention relates to a method for cleaning a plate heat exchanger, in which method the plate pack (2) of the plate heat exchanger is removed from the outer casing, the plate pack (2) is stretched in its longitudinal direction so that the spaces between the plates of the plate pack increase, and then the plate spaces of the plate pack are cleaned.

7 Claims, 4 Drawing Sheets

(51) Int. Cl.
*F28G 13/00* (2006.01)
*F28F 3/04* (2006.01)
*F28F 9/00* (2006.01)

(52) U.S. Cl.
CPC ..... *F28D 9/0043* (2013.01); *F28F 3/046* (2013.01); *F28F 3/083* (2013.01); *F28F 9/005* (2013.01)

(58) Field of Classification Search
USPC ..... 165/95
See application file for complete search history.

(56) References Cited

U.S. PATENT DOCUMENTS

| | | | | |
|---|---|---|---|---|
| 2003/0000688 | A1 | 1/2003 | Mathur et al. | |
| 2008/0073064 | A1 | 3/2008 | Gueguen | |
| 2011/0024082 | A1* | 2/2011 | Bharne | F28F 3/083 165/95 |
| 2012/0103578 | A1 | 5/2012 | Taylor | |
| 2013/0284412 | A1* | 10/2013 | Forstenius | F28F 3/083 165/166 |

FOREIGN PATENT DOCUMENTS

| | | |
|---|---|---|
| WO | WO 2010/132302 | 11/2010 |
| WO | WO 2013/106240 | 7/2013 |

OTHER PUBLICATIONS

Written Opinion of the ISA for PCT/FI2014/050256 dated Jul. 4, 2014, four pages.
FI Search Report for FI20135362 dated Feb. 13, 2014, one page.

* cited by examiner

METHOD FOR CLEANING PLATE HEAT EXCHANGER AND PLATE HEAT EXCHANGER

This application is the U.S. national phase of International Application No. PCT/FI2014/050256 filed 9 Apr. 2014 which designated the U.S. and claims priority to FI Patent Application No. 20135362 filed 12 Apr. 2013, the entire contents of each of which are hereby incorporated by reference.

FIELD OF THE INVENTION

The present invention relates to a method for cleaning a plate heat exchanger and a plate heat exchanger according to the preambles of the independent claims presented below.

BACKGROUND OF THE INVENTION

Plate and Shell type welded plate heat exchangers are previously known, which heat exchangers are composed of a plate pack formed by heat exchange plates and a shell surrounding it, functioning as a pressure vessel. The core of the heat exchanger is usually formed by a plate pack composed of circular heat exchange plates having openings, where the plates are welded tightly together at openings therein and/or at the perimeters of the plates. A primary circuit of the heat exchanger is formed between the openings in the plates into the plate pack and a secondary circuit between connections of the shell surrounding the plate pack, so that a primary side flow medium flows in every other plate space and a secondary side flow medium in every other plate space.

In processing and chemical industry, power plants and petroleum industry, fluids comprising dirt particles must typically be heated and/or cooled by using heat exchangers of the Plate and Shell type. The dirt particles might obstruct the plate heat exchanger, since the plate spaces of the plate pack are small. Thus, cleaning of the plate heat exchanger is necessary at certain intervals. There are plate heat exchangers which comprise openable outer casing so that the plate pack of the plate heat exchanger can be removed from the outer casing. Despite the openable plate heat exchanger construction, cleaning of the small plate spaces of the plate pack is difficult or even unfeasible. Another problem of heat exchangers of the Plate and Shell type related to the cleaning of the plate pack is that separate flow guides are needed on the shell side between the plate pack and the shell, which flow guides also complicate the cleaning of the plate pack.

Document U.S. 2008/0073064 discloses a heat exchanger wherein the fluid circuits are formed as a bundle consisting of a helical winding. The bundle is elastically deformable under a change of pressure and can be cleaned by removing the bundle and suppressing vacuum to it.

SUMMARY OF THE INVENTION

It is an object of the present invention to reduce or even eliminate the above-mentioned problems appearing in prior art.

Another object of the invention is to provide an easy method for cleaning a plate pack of a plate heat exchanger construction.

It is especially an object of the invention to provide a cleaning method for a plate heat exchanger and a plate heat exchanger construction which enable usage of uncleaner heat exchange medium in a shell side of the plate heat exchanger.

In order to achieve among others the objects presented above, the invention is characterized by what is presented in the characterizing parts of the enclosed independent claims.

Some preferred embodiments of the invention will be described in the other claims.

A typical method according to the invention for cleaning a plate heat exchanger relates to plate heat exchangers, which comprise

- a plate pack formed of circular heat exchange plates having openings and being arranged on top of each other, the height of which pack defines a longitudinal direction of the plate pack, and which plate pack comprises ends in the direction of the heat exchange plates and an outer surface defined by the outer edges of the heat exchange plates, and in which plate pack the heat exchange plates are attached to each other alternately at the openings of the plates and at the perimeters of the plates, and
- an outer casing surrounding the plate pack, which casing comprises end plates mainly in the direction of the ends of the plate pack and a shell connecting the end plates, of which end plates at least one is arranged to be openable.

A typical method according to the invention for cleaning a plate heat exchanger comprises at least the following steps

- opening at least one end plate of the outer casing,
- removing the plate pack from the outer casing,
- stretching the plate pack in its longitudinal direction so that the spaces between the plates of the plate pack increase, and
- cleaning the plate spaces of the plate pack.

A typical plate heat exchanger according to the invention comprises

- a plate pack formed of circular heat exchange plates having openings and being arranged on top of each other, which plate pack comprises ends in the direction of the heat exchange plates and an outer surface defined by the outer edges of the heat exchange plates, and in which plate pack heat exchange plates are attached to each other alternately at the openings of the plates and at the perimeters of the plates,
- an outer casing surrounding the plate pack, which casing comprises end plates mainly in the direction of the ends of the plate pack and a shell connecting the end plates, of which end plates at least one is arranged to be openable,
- removably arranged flow guides on the outer surface of the plate pack,
- support end plates of the plate pack in the ends of the plate pack, which support end plates are attached to the ends of the plate pack, and
- a stretching mechanism for stretching the plate pack arranged within the outer casing of the plate heat exchanger.

The embodiments and advantages mentioned in this text relate, where applicable, both to the plate heat exchanger and to the method according to the invention, even though it is not always specifically mentioned.

A typical plate heat exchanger of the invention comprises a cylindrical plate pack and a cylindrical outer casing surrounding it. The plate pack is typically fitted inside a cylindrical shell part functioning as a pressure vessel. The plate pack is formed of heat exchange plates so that heat exchange plates are attached to each other alternately at the openings of the plates and at the perimeters of the plates, wherein a flexible plate pack construction has been achieved. The heat exchange plates are usually corrugated. In a preferred embodiment of the invention a plate pack is made up of several plate pairs arranged on top of each other. Each plate pair is typically formed of two circular heat exchange plates that are welded together at least at their outer periphery. Each heat exchange plate has at least two openings for the flow of the first heat exchange medium. Adjacent plate pairs are attached together by welding the openings of two adjacent plate pairs to each other. Thus, the first heat exchange medium can flow from a plate pair to another via the openings, which openings form flow channels to the first heat exchange medium through the plate pack. The second heat exchange medium is arranged to flow inside the shell in the spaces between the plate pairs. Inlet and outlet connections for the first as well as for the second heat exchange medium have been arranged through the outer casing of the plate heat exchanger. The inlet and outlet connection of the first heat exchange medium have been arranged in connection with the inner parts of the plate pairs of the plate pack. The primary circuit of the plate heat exchanger is thus formed between the inlet and outlet connection of the first heat exchange medium. The inlet and outlet connections for the second heat exchange medium have been arranged in connection with the inner side of the shell, i.e. with the outer side of the pack of plates. In other words, the secondary circuit of the plate heat exchanger is formed between the inlet and outlet connection of the second heat exchange medium, inside the shell, in the spaces between the plate pairs. Typically, the primary and secondary circuits are separate from each other, i.e. the first heat exchange medium flowing in the inner part of the plate pack cannot get mixed with the second heat exchange medium flowing in the shell side, i.e. outside the plate pack. Thus, the first primary side heat exchange medium flows in every other plate space and the second secondary side heat exchange medium flows in every other plate space of the plate heat exchanger according to the invention.

The method of the invention is especially suitable for the above-mentioned heat exchanger construction of the Plate and Shell type. The heat exchanger of the invention is easy to disassemble and to rebuild, since at least one end plate of the outer casing of the plate heat exchanger is fixed with fastenings, and so the end plate can be opened and the plate pack can be taken out from the shell of the outer casing. The flow guides, which may be arranged on the outer surface of the plate pack, are also fixed to the construction with fastenings for allowing an easy detaching of the flow guides. Thus, the construction of the plate heat exchanger according to the invention makes possible an easy cleaning of the plate pack.

The cleaning method according to the invention is based on the fact that the plate pack of the Plate and Shell type heat exchanger can be easily stretched in its longitudinal direction so that the spaces between the plates of the plate pack (i.e. a cross sectional area of the plate spaces) increase and then the cleaning of the plate spaces is easier. Especially, the plate pack of heat exchangers of the Plate and Shell type, which is formed by using the plate pairs, is a flexible structure. The corrugated heat exchange plates of the plate pack improve the extensibility of the plate pack in comparison to the flat heat exchange plates. The extensibility of the plate pack is also dependent on the diameter of the heat exchange plates and the height of the corrugations of the heat exchange plates. The construction will normalize after stretching and it withstands the extension of its length several times without the construction being broken.

In an embodiment of the invention the plate pack is arranged on a separate support base after the plate pack has been removed from the shell of the outer casing. Typically, the plate pack is removed from the outer casing through an end of the shell, which end comprises the openable end plate. In a typical embodiment of the invention, the openable end plate of the outer casing has been attached to the plate pack construction and it has not been detached from it. Typically, the plate pack is arranged on a separate support base so that the inlet and outlet of the first heat exchange medium, i.e. the pack side's inlet and outlet, are upwards. In an embodiment of the invention, the plate pack is fixed to the support base by using separate fastening means.

A typical plate heat exchanger of the invention also comprises support end plates of the plate pack in the ends of the plate pack. In a typical embodiment of the invention the support end plates are fastened to the plate pack.

Typically, the plate heat exchanger comprises flow guides arranged on the outer surface of the plate pack. The aim of the flow guides is to guide flow of the shell side heat exchange medium through the plate pack. The flow guide structure can comprise a side plate, which is arranged against the outer surface of the plate pack, and flow guide structures are arranged to the edges of the side plate in the longitudinal direction of the plate pack. Typically, the length of the flow guides and the side plates is substantially the same as the length of the plate pack. In a preferred embodiment of the invention, the flow guides are fixed with fastenings to the support ends of the plate pack construction, and so they can be removed from the outer surface of the plate pack before stretching the plate pack.

The plate pack can be stretched by using a stretching mechanism, which can be a fixed part of the plate pack construction or a separate stretching mechanism, which will be assembled around the plate pack construction after the plate pack has been removed out of the shell. Indeed, according to an embodiment, the method further comprises arranging a stretching mechanism, such as at least two screwing taps, for stretching the plate pack around the plate pack. The plate pack can be stretched by using a stretching mechanism, such as screwing taps, which is a fixed part of the plate pack construction.

In an embodiment of the invention the stretching mechanism typically comprises at least two, and more typically at least three or four, screwing taps or the like, arranged around the plate pack. In a preferred embodiment of the invention the stretching mechanism comprises at least four screwing taps or the like. The mechanism can be a fixed part of the plate pack construction or the mechanism can be a separate construction which is arranged around the plate pack after the plate pack is removed from the outer casing of the heat exchanger. Typically, the screwing taps are arranged around the plate pack. In an embodiment of the invention, the first ends of the stretching mechanism, such as screwing taps, are fixed to the separate support base and the second ends of the stretching mechanism are fixed to the end plate of the plate heat exchanger attached to the plate pack. In a fixed construction, the screwing taps are typically fixed to the support end plates of the plate pack or they are a part of the support end construction. Indeed, the stretching mechanism can be fixed to the support end plates of the plate pack.

The stretching mechanism is movable between its first position and second position, i.e. between the positions in which the plate pack is not stretched (a normal position) and the position in which the plate pack is stretched (a stretchable position). The stretching mechanism will also keep the plate pack in its stretched position.

In an embodiment of the invention the plate pack is stretched by using a hoisting apparatus. The hoisting apparatus can be fixed to the end plate attached to the plate pack. In an embodiment of the invention the plate pack construction is supported with other stretching mechanism, such as screwing taps or the like, or with other support structures when the plate pack is stretched with the hoisting apparatus so that the plate pack construction will stay in upright position during stretching.

Typically, the length of the plate pack in its longitudinal direction is stretched about one or two times greater than the length of the plate pack in a normal position. In the normal position, the plate pack is typically slightly compressed. The normal position refers to the plate pack arranged inside the outer casing when the plate heat exchanger is in operation. During stretching, e.g. the screwing taps are extended to the desired length and thus also the length of the plate pack stretches in relation to the extended screwing taps. When the plate pack is stretched, the gap between the heat exchange plates of the plate pack is greater than in the normal position, i.e. the heat exchange plates mainly touch each other only from the area of the welded edges, and thus the cleaning of the plate spaces is easier. After cleaning, the stretching mechanism can be moved back to the starting position, wherein the plate pack returns back to its normal position (i.e. a normal length of the plate pack).

Depending on the diameter of the heat exchange plates of the plate pack and the height of the plate pack, the plate pack might stretch more in its upper part than in its lower part. In an embodiment of the invention a separate support mechanism is arranged into the plate pack in order to stretch the plate pack evenly in the whole length of the plate pack. This also helps to eliminate the possibility to break the plate pack construction during the stretching. The support mechanism can be any type of construction, which can be arranged into the plate pack either in a shell side (i.e. between plate pairs) or in a pack side (i.e. inside the flow channels of the plate pack), which construction makes it possible to stretch the plate pack so that it will stretch evenly in the whole length of the plate pack. In an embodiment of the invention at least one support plate extending through the plate pack is arranged into the plate space of the plate pack, wherein the ends of the support plate are arranged in connection with the stretching mechanism, such as screwing taps, arranged around the plate pack. In another embodiment of the invention, two or more support plates are arranged through the plate pack. Thus, the plate pack can be stretched as evenly as possible. The number and the placing of the support plates depend on the height of the plate pack.

DESCRIPTION OF THE DRAWINGS

The invention will be described in more detail with reference to the appended drawings, in which.

DETAILED DESCRIPTION OF THE INVENTION

In FIGS. 1 to 9, the same reference numbers have been used for parts corresponding to each other, even though the parts marked with the same reference numbers can be different in different examples.

Figure 1:
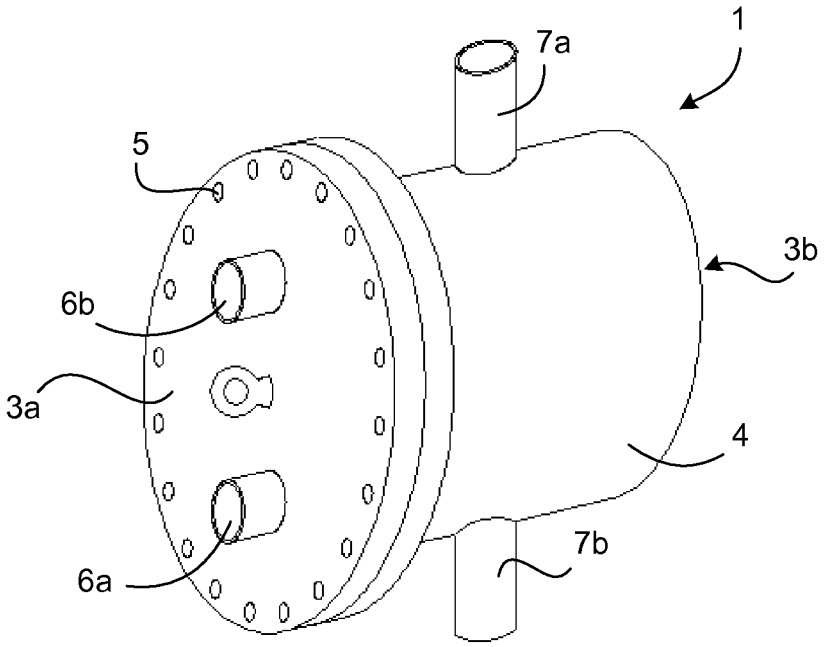
FIG. 1 shows a plate heat exchanger according to an embodiment of the invention.

FIG. 1 presents an openable plate heat exchanger according to an embodiment of the invention seen from the outside. The plate heat exchanger 1 comprises an outer casing surrounding the plate pack comprising end plates 3*a*, 3*b* and a shell 4 connecting the end plates. At least one of the end plates is arranged to be openable, i.e. the end plate 3*a* is fixed with removable fastenings 5 to the plate heat exchanger construction. The end plate 3*a* comprises inlet and outlet connections 6*a*, 6*b* for the first heat exchange medium flowing inside the plate pack. The inlet and outlet connections 7*a*, 7*b* for the second heat exchange medium are arranged through the outer casing of the plate heat exchanger.

Figure 2:
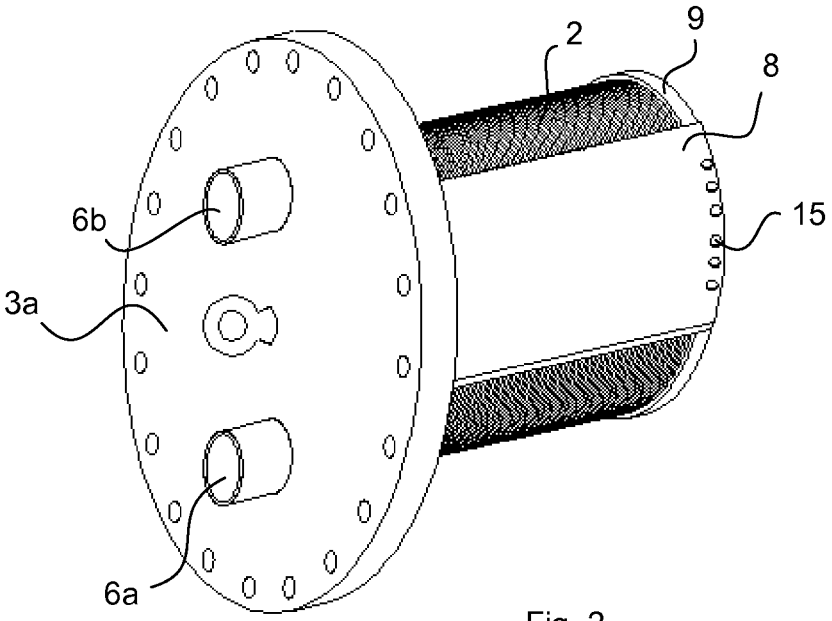
FIG. 2 shows a plate pack construction according to an embodiment of the invention.

FIG. 2 illustrates a plate pack construction according to an embodiment of the invention, which is removed from the shell of the outer casing. On the outer surface of the plate pack 2 has been arranged flow guides 8 (only one flow guide is shown in the Figure). The flow guide 8 can be detached from the plate pack, since it has been fixed with detachable fastenings 15. The plate pack construction also comprises support end plates 9 arranged to the ends of the plate pack. The support end plate attached to the end plate 3*a* is out of sight in the Figures.

Figure 3:
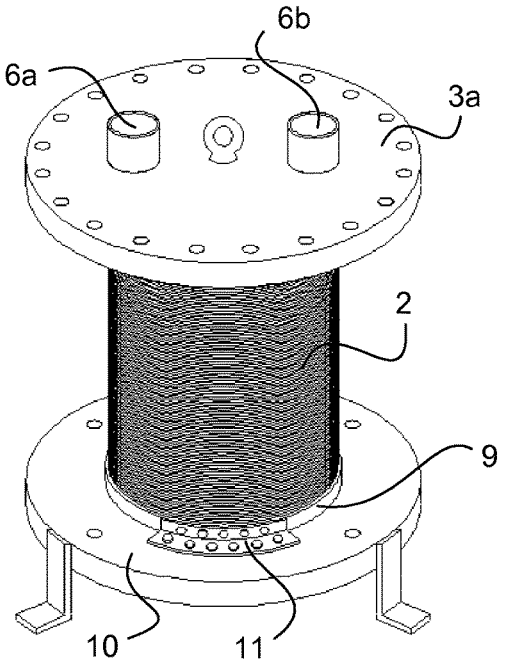
FIG. 3 shows a plate pack construction according to an embodiment of the invention arranged on a support base.

FIG. 3 shows a plate pack construction of FIG. 2, when the flow guides are taken off, and when the plate pack is arranged on a separate support base 10 so that the inlet and outlet of the first heat exchange medium 6*a*, 6*b* are upwards. The plate pack construction is fixed to the support base 10 by using separate fastening means 11. The fastening means 11 are typically fixed to the support end plate 9 of the plate pack construction.

Figure 4:
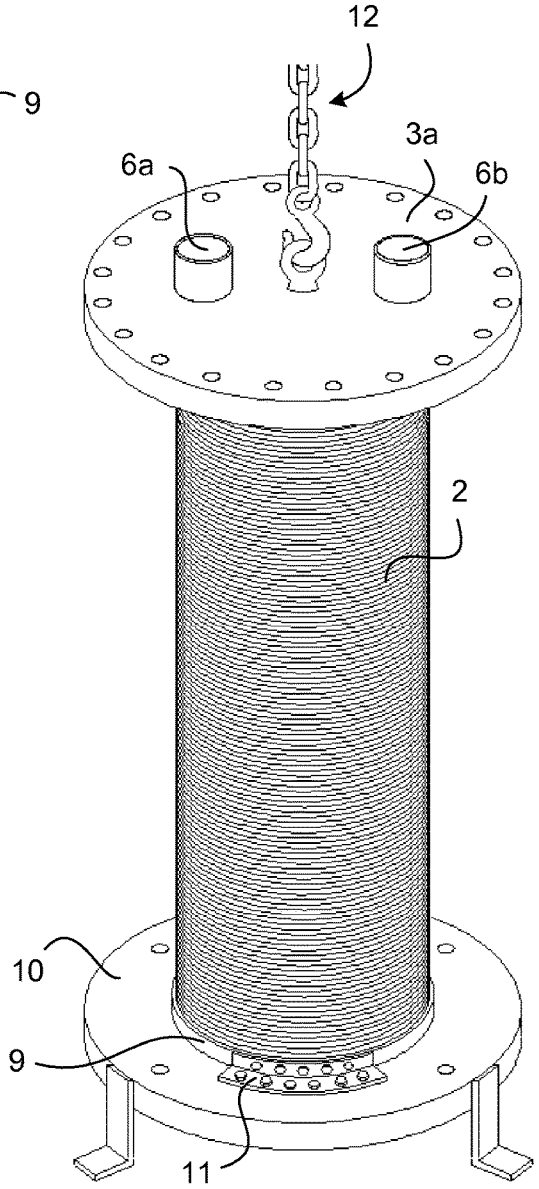
FIG. 4 shows a stretched plate pack construction according to an embodiment of the invention.

FIG. 4 shows the plate pack 2 according to the invention in a stretchable position. In FIG. 4, the plate pack 2 has been stretched about two times longer in comparison to its normal position. The plate pack 2 can be stretched e.g. by using a hoisting apparatus 12, which is arranged in contact with the end plate 3*a*.

Figure 5:
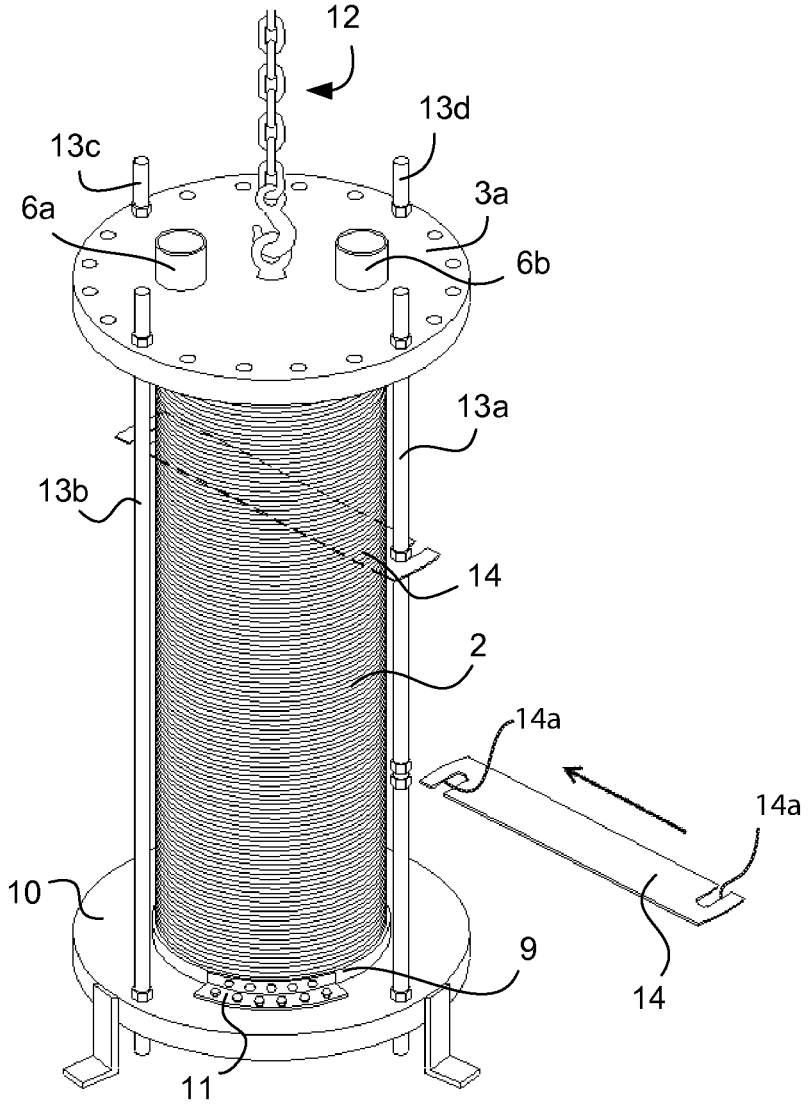
FIG. 5 shows a stretched plate pack construction and a support plate arranged into the plate pack according to an embodiment of the invention.

FIG. 5 also shows the plate pack 2 in a stretchable position. Around the plate pack 2 has been arranged four screwing taps 13*a*, 13*b*, 13*c*, 13*d* or the like, which have been fastened to the support base 10 and to the end plate 3*a*. FIG. 5 also illustrates the arranging of a planar support plate 14 into the plate pack 2 according to an embodiment of the invention so that the plate pack 2 can be stretched evenly in the whole length of the plate pack. The support plate 14 will be arranged into the plate pack 2 between the heat exchange plates so that it extends diametrically through the plate pack with the oppositely oriented U-shaped slots 14*a* at each of the terminal ends of the support plate 14 being removably attached to a respective one of the screwing taps 13*a*, 13*c* or the like. Thus, the support plate 14 prevents the stretching of the plate pack 2 more in its upper part than in its lower parts.

Figure 6:
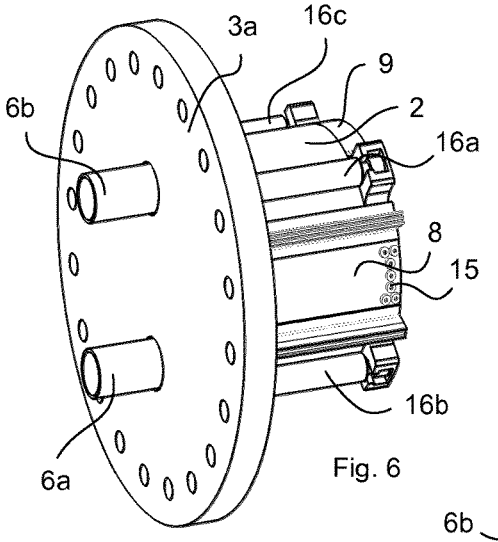
FIG. 6 shows a plate pack construction with a fixed stretching mechanism according to an embodiment of the invention.

A plate pack construction with a fixed stretching mechanism according to an embodiment of the invention is shown in FIG. 6. On the outer surface of the plate pack 2 has been arranged a fixed stretching mechanism, such as screwing taps 16*a*-16*c*, and flow guides 8 (only one flow guide is shown in the Figure). The screwing taps 16*a*, 16*b*, 16*c* have been arranged around the plate pack. The ends of the screwing taps are fixed to the support ends 9 of the plate pack construction. The flow guide 8 has been fixed to the plate with fastenings 15 and so it can be detached from the plate pack before stretching.

Figure 7:
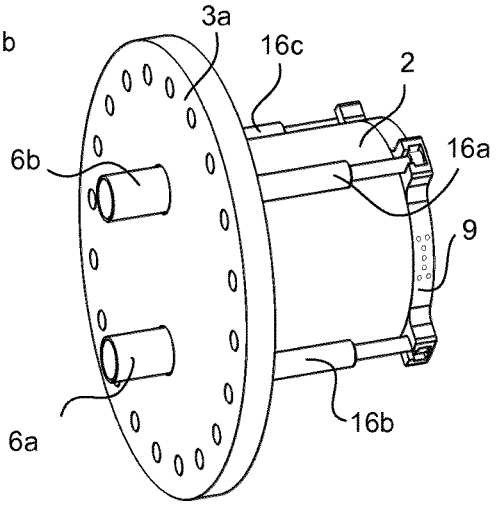
FIG. 7 shows the plate pack construction of FIG. 6 in a stretchable position.

FIG. 7 shows the plate pack construction of FIG. 6 in a stretchable position. The screwing taps 16*a*, 16*b*, 16*c* have been extended to the desired length and also so the plate pack 2 has been stretched in relation to the extended screwing taps. With a fixed stretching mechanism shown in FIGS. 6 and 7, the plate pack can also be stretched when the plate pack is placed in a horizontal direction.

Figure 8:
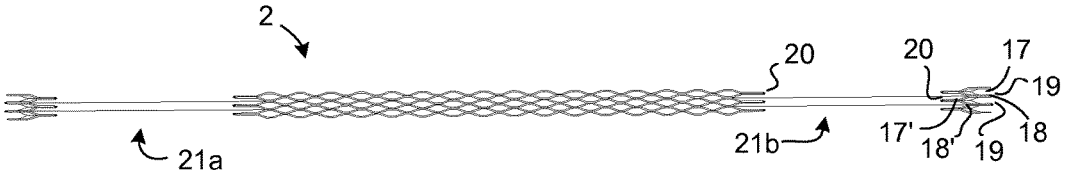
FIG. 8 shows a cross-section of the plate pack in a normal position.
Figure 9:
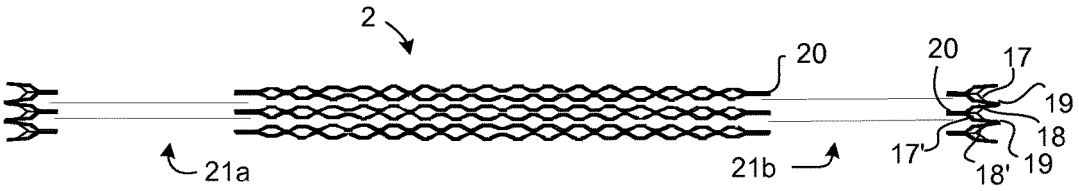
FIG. 9 shows a cross-section of the plate pack in a stretchable position.

FIGS. 8 and 9 illustrate a detailed cross-section of the plate pack in a normal and a stretchable position. The plate pack 2 has been formed of corrugated heat exchange plates 17, 18, 17', 18' having openings 21*a*, 21*b*. The plate pack has been made up of several plate pairs arranged on top of each other. Each plate pair has been formed of two heat exchange plates 17, 18; 17', 18' that have been joined together. The heat exchange plates are attached to each other alternately at the openings of the plates (a welding joint 20) and at the perimeters of the plates (a welding joint 19). The corrugations of the heat exchange plates, i.e. the grooves and the ridges between them, produces a diamond shape to the plate spaces. In a normal position of the plate pack as shown in FIG. 8, the heat exchange plates 17, 18, 17', 18' are closely against each other in all contacting points of the plates. When the plate pack 2 has been stretched, the spaces between the plates 17, 18, 17', 18' will increase as shown in FIG. 9. Thus, the cleaning of the plate spaces is easier than in the normal position.

The invention is not restricted to the examples of the above description, but it can be modified within the scope of the inventive idea presented in the claims.

The invention claimed is:

1. A method for cleaning a plate heat exchanger comprising the steps of:

(a) providing a plate heat exchanger comprised of:

(i) a plate pack formed of a stack of circular heat exchange plates having outer perimeter edges and openings, the heat exchange plates being arranged so as to be adjacently stacked on top of each other and thereby establish respective spaces therebetween, wherein the plate pack has a height which defines a longitudinal direction thereof, wherein the plate pack includes opposed first and second ends in the longitudinal direction of the stack of heat exchange plates and an outer surface defined by the outer perimeter edges of the heat exchange plates, the heat exchange plates being attached to each other alternately at the openings and at the outer perimeter edges of the heat exchange plates, and (ii) an outer casing surrounding the plate pack, the outer casing comprising an end plate which is attached to the first end of the plate pack in the longitudinal direction thereof, and a shell surrounding the plate pack, wherein the end plate is removably connected to the shell so as to be openable relative to the shell and thereby allow removal of the end plate and the plate pack from the shell, (b) opening the outer casing by disconnecting the end plate from the shell of the outer casing, (c) removing the plate pack and the end plate from the outer casing, (d) positioning the removed plate pack and end plate relative to a support base so that the second end of the plate pack is supported by the support base opposite to the end plate at the first end of the plate pack, and positionally fixing the second end of the plate pack to the support base, (e) arranging a support and stretching mechanism relative to the plate pack in order to allow the plate pack to stretch evenly throughout a lengthwise extent of the plate pack along the longitudinal direction thereof by:

(1) positioning at least one diametrically opposed pair of elongate screwing taps parallel to the longitudinal direction of the plate pack adjacent to the outer perimeter edges of the heat exchange plates, and operatively connecting each of the screwing taps to the support base and the end plate so that operation of the screwing taps changes a dimensional extent in the longitudinal direction of the plate pack between the support base and the end plate, (2) positioning at least one planar support plate having opposed terminal ends between a predetermined adjacent pair of the adjacently stacked heat exchange plates such that the planar support plate extends diametrically through the plate pack so as to span a diametrical distance between the pair of elongate screwing taps, and (3) removably attaching each of the terminal ends of the at least one planar support plate to a respective one of the elongate screwing taps, (f) stretching the plate pack in the longitudinal direction thereof so as to dimensionally increase the respective spaces between each of the adjacently stacked heat exchange plates of the plate pack in the longitudinal direction thereof, and (g) cleaning the dimensionally increased respective spaces between the adjacently stacked heat exchange plates of the plate pack.

2. The method according to claim 1, wherein the plate heat exchanger further comprises flow guides positioned at the outer surface of the plate pack, and wherein prior to step (f), the method further comprises the step of removing the flow guides from the outer surface of the plate pack.

3. The method according to claim 1, which further comprises providing the screwing taps as a fixed part of the plate pack, and wherein step (f) comprises operating the screwing taps to dimensionally increase the respective spaces between the adjacently stacked ones of the heat exchange plates of the plate pack in the longitudinal direction thereof.

4. The method according to claim 1, wherein step (f) comprises stretching the plate pack by a hoisting apparatus.

5. The method according to claim 1, wherein step (f) is practiced such that the lengthwise extent of the plate pack is stretched between about one to two times greater than an original lengthwise extent of the plate pack prior to stretching.

6. The method according to claim 1, which comprises providing U-shaped slots at each of the terminal ends of the planar support plate for removable engagement with a respective one of the elongate screwing taps.

7. The method according to claim 6, wherein the U-shaped slots are oppositely oriented relative to one another.

* * * * *